US009243841B2

(12) United States Patent
Lu et al.

(10) Patent No.: US 9,243,841 B2
(45) Date of Patent: Jan. 26, 2016

(54) DISPENSER NICHE FOR A REFRIGERATOR

(75) Inventors: Songtao Lu, Chuzhou (CN); Alexander Rupp, Nanjing (CN); Lisheng Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 792 days.

(21) Appl. No.: 13/058,878

(22) PCT Filed: Aug. 7, 2009

(86) PCT No.: PCT/EP2009/060291

§ 371 (c)(1), (2), (4) Date: Feb. 14, 2011

(87) PCT Pub. No.: WO2010/023090

PCT Pub. Date: Mar. 4, 2010

(65) Prior Publication Data

US 2011/0139817 A1 Jun. 16, 2011

(30) Foreign Application Priority Data

Aug. 28, 2008 (DE) ..... 10 2008 041 670

(51) Int. Cl.

| | |
|---|---|
| ***F25D 23/00*** | (2006.01) |
| ***F25D 27/00*** | (2006.01) |
| *F25C 5/00* | (2006.01) |
| *F25D 23/12* | (2006.01) |

(52) U.S. Cl.

CPC ..... *F25D 27/00* (2013.01); *F25C 5/005* (2013.01); *F25D 23/126* (2013.01)

(58) Field of Classification Search

CPC ..... F25D 27/00; F21S 13/12; G02B 25/00; G02B 25/02; G02B 25/002

USPC ..... 62/264; 312/223.5; 362/92

See application file for complete search history.

(56) References Cited

U.S. PATENT DOCUMENTS

| | | | | |
|---|---|---|---|---|
| 2,644,145 | A * | 6/1953 | Adams | 439/824 |
| 5,938,310 | A * | 8/1999 | Leaman et al. | 362/26 |
| 6,804,974 | B1 | 10/2004 | Voglewede et al. | |
| 6,979,107 | B1 * | 12/2005 | Benensohn | 362/374 |
| 7,340,914 | B2 | 3/2008 | Bowen et al. | |
| 7,617,698 | B2 * | 11/2009 | Bowen et al. | 62/264 |
| 2004/0179350 | A1 | 9/2004 | Ortega | |
| 2006/0145180 | A1 * | 7/2006 | Galli | 257/99 |

(Continued)

FOREIGN PATENT DOCUMENTS

| | | | |
|---|---|---|---|
| CN | 1940427 | A | 4/2007 |
| CN | 1959316 | A | 5/2007 |
| DE | 202006013708 | U1 | 12/2006 |

OTHER PUBLICATIONS

Report of Examination CN 200980133204.

*Primary Examiner* — Jonathan Bradford
*Assistant Examiner* — Orlando Aviles Bosques
(74) *Attorney, Agent, or Firm* — James E. Howard; Andre Pallapies

(57) ABSTRACT

A dispenser niche for a refrigerator is provided. The dispenser niche includes an illuminator to at least partially illuminate the niche. The illuminator has LEDs that are arranged on a common circuit board with first electrical contacts. A wall of the dispenser niche has second electrical contacts and a recess that receives the common circuit board in a single orientation. The first electrical contacts of the common circuit board and the second electrical circuits of the wall touch each other in the single orientation.

20 Claims, 3 Drawing Sheets

(56) References Cited

U.S. PATENT DOCUMENTS

2006/0201190 A1 9/2006 Bowen et al.
2006/0237439 A1 10/2006 Norwood et al.
2006/0262544 A1* 11/2006 Piepgras et al. ..... 362/373
2007/0044497 A1 3/2007 Roo et al.
2007/0058369 A1* 3/2007 Parkyn et al. ..... 362/235

* cited by examiner

DISPENSER NICHE FOR A REFRIGERATOR

BACKGROUND OF THE INVENTION

The present invention relates to a dispenser niche for a refrigerator, in particular a household refrigerator, at which the contents of the refrigerator, such as ice or chilled water can be dispensed, without a door of the appliance needing to be opened.

A user standing in front of the appliance in order to remove cooled material generally casts a shadow over the niche with his body. Without an illuminating device in the niche itself it is thus often difficult to detect the fill level of a vessel placed in the niche and to terminate a dispensing procedure in a timely manner, when a desired fill level of the vessel is reached.

With the use of conventional incandescent bulbs as the means of illumination, the problem arises that an incandescent bulb with sufficient lighting output can be accommodated in the niche only with difficulty due to its dimensions. As a result of the high level of heat given off by the incandescent bulb, heat-sensitive parts must maintain a considerable safety-related distance from the incandescent bulb, which makes their incorporation even more difficult. Although halogen bulbs achieve better light yields coupled with compact dimensions, their high surface temperatures mean that it is scarcely any simpler to accommodate them than is the case with a conventional incandescent bulb.

As at best a single means of illumination can be accommodated, shadows may arise in the niche or the vessel placed therein, which even in the case of good levels of lighting render the correct estimation of the fill level difficult.

BRIEF SUMMARY OF THE INVENTION

It is the object of the present invention to specify a dispenser for a refrigerator which avoids the aforementioned disadvantages.

The object is achieved in that the illuminating device of the dispenser niche is formed from a multiplicity of LEDs. As LEDs achieve higher levels of efficiency than thermal emitters, they heat their environment only to a minor extent even in the case of high luminous intensity, so that at worst it is necessary to maintain only minor safety distances between the LEDs and temperature-sensitive parts of the dispenser niche. As the dimensions of the LEDs are small, it presents no difficulties to accommodate a multiplicity of them, in order to illuminate the contents of a vessel placed within the niche from different directions. Deep shadows which render difficult the correct estimation of the fill level can thus be avoided.

In order to eliminate the zones of shade in the niche the multiplicity of LEDs are preferably arranged in the form of a polygon.

Expediently, the LEDs are located in a wall of the niche having a dispensing aperture for the material to be removed.

The polygon preferably overlaps the dispensing aperture, in order to minimize shadows in a vessel to be filled positioned in the niche.

Alternatively it can be provided for the contour of the dispensing aperture to surround the polygon.

To each LED a beam-forming optical element can expediently be assigned, in order to shape the cone of beams of the LEDs to match the form of the niche.

In order to simplify the construction of the dispenser niche, the beam-forming elements can be connected with each other in one piece.

The LEDs and the beam-forming elements are preferably accommodated in at least one accommodation which is open at the bottom. The dazzling of the user by light shining out of the niche can thereby be avoided.

A single accommodation is preferably provided, which surrounds the dispensing aperture.

This accommodation can expediently be circular or in particular sector-shaped.

To simplify the assembly the LEDs can further be arranged on a common circuit board.

The accommodation in the wall is preferably formed such as to permit the location of circuit board therein in a single orientation, in which electrical contacts of the wall and the circuit board touch each other. Correct contacting of the circuit board is thus guaranteed solely through its placement in the accommodation.

For fixing of the parts inserted into the accommodation, such as perhaps the LEDs, their circuit board or the beam-forming elements in the accommodation, the latter is preferably closed at the bottom by mean of a cover piece.

The cover piece can at least locally be transparent, in order to allow the passage of the light from the LEDs.

In this case the beam-forming elements can expediently be embodied in one piece with the cover piece.

Alternatively, the cover piece can also have openings directed towards the LEDs. The cover piece itself can then be opaque.

The beam-forming elements then preferably engage in the openings.

For fixing, the cover piece can in particular be friction-welded on the wall.

BRIEF DESCRIPTION OF THE DRAWINGS

Further features and advantages of the invention are evident from the following description of exemplary embodiments, with reference to the attached figures, in which.

DETAILED DESCRIPTION OF EXEMPLARY EMBODIMENTS OF THE PRESENT INVENTION

Figure 1:
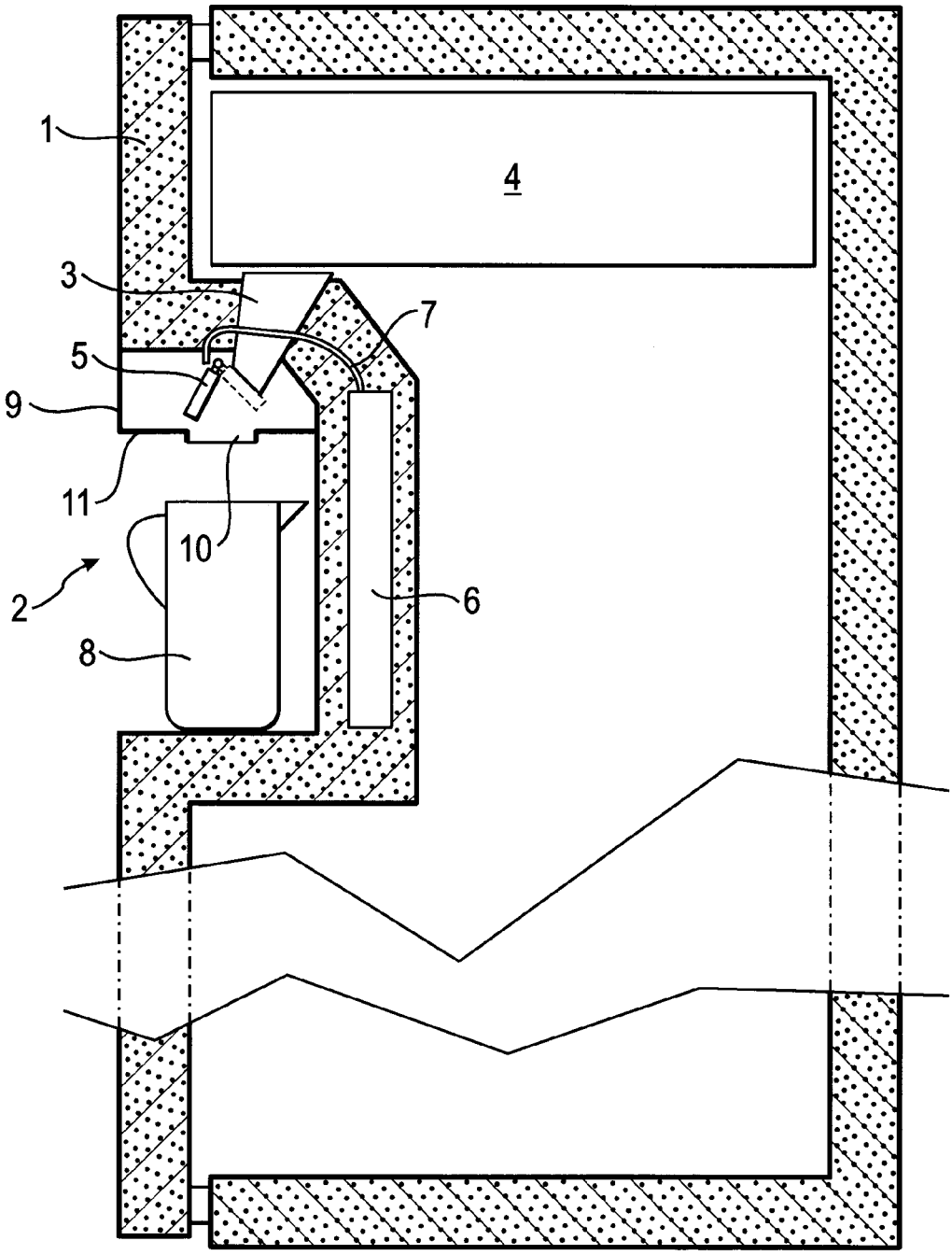
FIG. 1 shows a schematic section through a refrigerator with a dispenser niche.

FIG. 1 shows a schematic section through a household refrigerator, in which a niche 2 for dispensing of ice and chilled water is formed in a door 1. A through-channel 3 extends from a dispensing aperture of an automatic ice-making machine 4 accommodated in the interior of the refrigerator through a heat insulated cover of the niche 2, and is provided at its lower end with a pivotable flap 5. The flap 5 can block off the lower end of the through-channels 3 in a position represented by a dashed line, in order to prevent the ingress of warm air from the niche 2 into the interior of the refrigerator, or it can, here represented by continuous lines, be pivoted away from the through-channel 3, in order to allow ice to pass through.

An outlet end of a hose 7 connected to a cold water tank 6 is fixed via the flap 5 in such a position that with the flap 5 closed, water can be tapped via the hose 7 from tank 6 into a vessel 8 placed in the niche.

For its protection, the flap 5 is concealed behind an injection-molded fascia panel 9, an opening 10, through which dispensed water and ice pass, is formed in a horizontal base plate 11 of the fascia panel 9.

Figure 2:
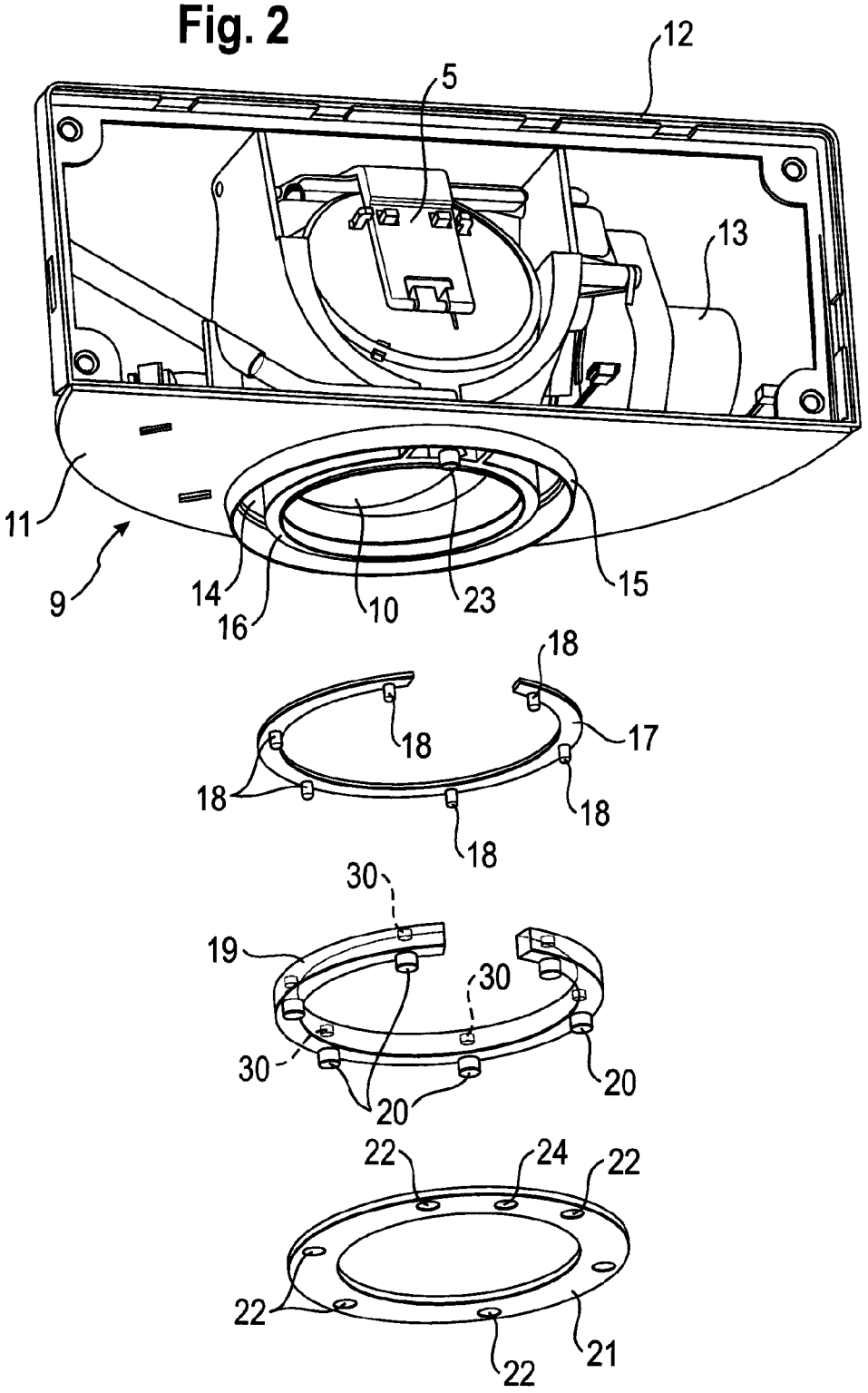
FIG. 2 shows an exploded view of a built-in part of niche and of components of an illuminating device provided therein.

FIG. 2 shows the fascia panel 9 in an enlarged perspective view. A plate, which in the assembled state fills a vertical frame 12 of the fascia panel 9, is omitted in FIG. 2, so that the pivotable flap 5 and a motor or electromagnet 13 driving the same is visible.

The opening 10 is surrounded on the underside of the base plate 11 by two annular ribs 15, 16, which form an arc-shaped accommodation 14.

A circuit board 17 in the shape of an arc complementary to the accommodation 14 is provided for placement in the accommodation 14. It is equipped on its underside with SMD-LEDs 18. In the present case, these LEDs 18 are six in number, and form the corners of an equilateral hexagon. The number of LEDs 18 can of course be greater or smaller according to their power and the desired strength of illumination in the niche 2.

Shown underneath the circuit board 17 is a transparent plastic body 19, which like the circuit board 17 is arc-shaped, complementary to accommodation 14. Recesses 30 to accommodate the LEDs 18 can be provided on the top side of the plastic body 19, so that in the assembled state, the plastic body 19 can touch the circuit board 17 between the LEDs 18. The recesses 30 can in each case be provided on their base with a beam-forming surface such as for example a concave or convex lens, in order to convert the generally tightly bundled beam of the LEDs 18 into a divergent beam, with which the niche 2 can be evenly illuminated.

Cylindrical projections 20 on the underside of the plastic body 19 are in each case arranged opposite the LEDs 18, so that light from the latter is beamed through these. The projections 20 can also be embodied as lenses for beam-forming purposes.

Finally, an opaque plastic ring 21 is show below the plastic body 19, which has openings 22 complementary to the projections 20 and an opening 24 complementary to a centering pin 23 of the base plate 11. The ring 21 is provided, in order, after arrangement of the circuit board 17 and the plastic body 19 in the accommodation 14, to be mounted on the ribs 15, 16 and fixed to these by means of friction-welding.

Figure 3:
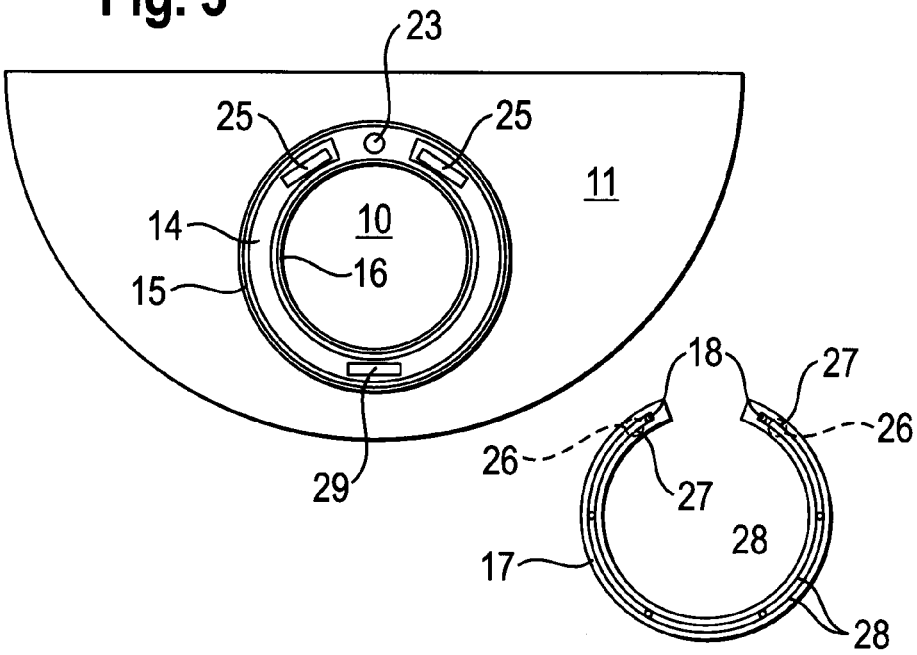
FIG. 3 shows a view of the built-in part and a circuit board to be mounted thereupon, from below.

FIG. 3 shows a view of the base plate 11 and the circuit board 17 seen from below. It is possible here to see at the base of the accommodation 14 on both sides of the centering pin 23 two curved leaf springs 25, in each case spread in their center from the base of the accommodation 14, which are connected to a supply or mass potential respectively via through-contacts of the base plate 11 (not shown). On the top side of the circuit board 17 facing away from the observer in FIG. 3, two contact fields 26 shown in the figure as dashed circles are placed such that when the circuit board 17 is placed in the accommodation 14, they in each case contact the projecting central area of the bent leaf springs 25. Each of the two contact fields 26 is connected via a through-contact 27 to one of two concentric conductor paths 28 on the underside of the circuit board 17, which supply the LEDs 18. A correct contacting of the LEDs 18 is thus guaranteed solely through the placement of the circuit board 17 in the accommodation 14.

In order to fix the circuit board 17 of the accommodation 14 in a stable manner without any play, at least one further leaf spring 29 can be arranged in the accommodation 14, preferably diametrically opposite the centering pin 23. The leaf spring 29 is electrically unconnected. The three leaf springs 23, 23, 29 fix the circuit board 17 and the plastic body 19, in that they hold both pressed against the ring 21.

Figure 4:
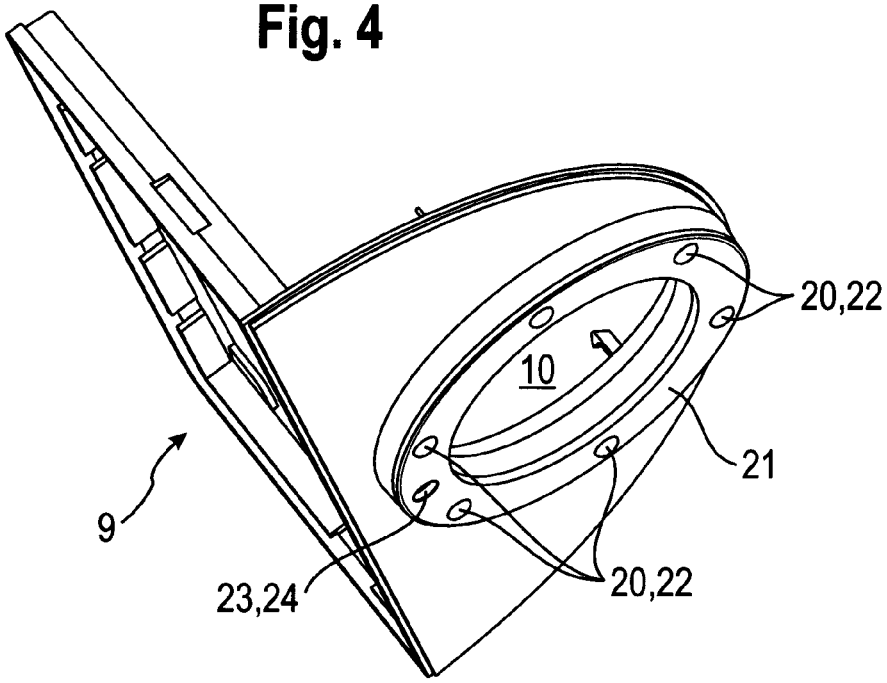
FIG. 4 shows a perspective view of the built-in part with ready-mounted illuminating device.

FIG. 4 shows the fascia panel 9 with a ready-mounted illuminating device. The accommodation 14 is covered by the ring 21, and the projections 20 of the plastic body 19 can be seen in the openings 22 of the ring. The projections 20 have a convex curve and function as a converging lens of short focal length, which converts the tightly bundled beam on an LED 18 into a beam diverging beyond its focal point.

According to an alternative embodiment which is not shown, the ring 21 and the plastic body 19 can be molded into a single molding. This molding can be completely transparent, or it can be provided with an opaque coating away from the exit areas of the LED beams.

According to a second alternative, the SMD-LEDs 18 can be replaced with LEDs with a per se known, dome-shaped plastic housing, which assumes the beam-forming function of the projections 20 of the plastic body 19 and in their place engages in the openings 22 of the ring 21.

The invention claimed is:

1. A dispenser niche for a refrigerator, the dispenser niche comprising:

an illuminator to at least partially illuminate the niche, the illuminator having a plurality of LEDs that are arranged on a common circuit board having first electrical contacts; and a wall having second electrical contacts and a recess, the recess to receive the common circuit board in a single orientation;

wherein the first electrical contacts of the common circuit board and the second electrical contacts of the wall touch each other in the single orientation.

2. The dispenser niche of claim 1, wherein the refrigerator is a household refrigerator.

3. The dispenser niche of claim 1, wherein the plurality of LEDs form a polygon.

4. The dispenser niche of claim 3, wherein the wall has a dispensing aperture, and wherein the polygon overlaps the dispensing aperture.

5. The dispenser niche of claim 3, wherein the wall has a dispensing aperture, and wherein the contour of the dispensing aperture surrounds the polygon.

6. The dispenser niche of claim 1, wherein the wall has a dispensing aperture.

7. The dispenser niche of claim 1, wherein a respective one of a plurality of beam-forming optical elements is assigned to each of the plurality of LEDs.

8. The dispenser niche of claim 7, wherein the plurality of beam-forming optical elements are connected to each other in one piece.

9. The dispenser niche of claim 7, wherein a bottom of the recess is open, and wherein the plurality of beam-forming optical elements are accommodated in the recess.

10. The dispenser niche of claim 9, wherein the wall has a dispersing aperture, and wherein the recess surrounds the dispensing aperture.

11. The dispenser niche of claim 9, wherein the recess is one of circular and sector-shaped.

12. The dispenser niche of claim 1, wherein the bottom of the recess is closed by a cover part.

13. The dispenser niche of claim 12, wherein the cover part is at least locally transparent.

14. The dispenser niche of claim 12, wherein a respective one of a plurality of beam-forming optical elements is assigned to each of the plurality of LEDs, and wherein the plurality of beam-forming optical elements are embodied in one piece with the cover part.

15. The dispenser niche of claim 12, wherein the cover part has a plurality of openings directed towards the plurality of LEDs.

16. The dispenser niche of claim 15, wherein the plurality of beam-forming optical elements engage in a respective one of the plurality of openings.

17. The dispenser niche of claim 12, wherein the cover part is friction-welded to the wall.

18. A dispenser niche for a refrigerator, the dispenser niche comprising:

a wall having a dispensing aperture, annular ribs defining an accommodation and first electric contacts which comprise springs;

a circuit board received in the accommodation, the circuit board having:

second electric contacts which contact the first electric contacts when the circuit board is placed in the accommodation;

conductor paths connected to the second electric contacts;

a plurality of LEDs supplied by the conductor paths and which are arranged in a polygon that overlaps the dispensing aperture; and a transparent body received in the accommodation, the transparent body having a plurality of recesses each of which receive a corresponding LED, and a plurality of beam-forming optical projections arranged opposite a corresponding LED.

19. The dispenser niche of claim 18, further comprising a ring mounted on the ribs of a base plate, the ring having a plurality of openings each of which receives a corresponding LED.

20. A dispenser niche for a refrigerator, the dispenser niche comprising:

a wall having annular ribs defining an accommodation and first electric contacts which comprise springs;

a circuit board having second electric contacts and a plurality of LEDs, the circuit board being received in the accommodation such that the second electric contacts contact the first electric contacts, the LEDs being supplied by conductor paths on the circuit board and the conductor paths being connected via a through contact on the circuit board to the second electric contacts; and a transparent body received in the accommodation, the transparent body having a plurality of recesses at a upper surface thereof, each recess receiving a corresponding LED, and a plurality of beam-forming optical elements at a lower surface thereof and arranged opposite a corresponding LED.

* * * * *